US010143866B2

(12) United States Patent
Yang et al.

(10) Patent No.: US 10,143,866 B2
(45) Date of Patent: Dec. 4, 2018

(54) LOCKABLE ANTI-FALL CATCH CONNECTOR

(71) Applicant: Aerohook Technology Co., Ltd., Taichung (TW)

(72) Inventors: Kai Chieh Yang, Taichung (TW); Yang-Tsung Chen, Taichung (TW); Yi-Ching Lin, Taichung (TW)

(73) Assignee: Aerohook Technology Co., Ltd., Taichung (TW)

( * ) Notice: Subject to any disclaimer, the term of this patent is extended or adjusted under 35 U.S.C. 154(b) by 171 days.

(21) Appl. No.: 15/257,872

(22) Filed: Sep. 6, 2016

(65) Prior Publication Data

US 2017/0319880 A1 Nov. 9, 2017

(30) Foreign Application Priority Data

May 6, 2016 (TW) ..... 105206516 U

(51) Int. Cl.
*A62B 35/00* (2006.01)
*A63B 29/02* (2006.01)

(52) U.S. Cl.
CPC ..... *A62B 35/0068* (2013.01); *A62B 35/0025* (2013.01); *A62B 35/0037* (2013.01); *A63B 29/02* (2013.01)

(58) Field of Classification Search
CPC . A62B 35/0068; A62B 35/0025; A63B 29/02; F16M 13/022; F16B 45/04; F16G 15/06; Y10T 403/32893; Y10T 403/599
See application file for complete search history.

(56) References Cited

U.S. PATENT DOCUMENTS 4,337,614 A * 7/1982 Briscoe ..... F16G 15/06 411/518
5,114,260 A * 5/1992 Hart ..... F16G 15/06 403/154
5,367,798 A * 11/1994 Hughes ..... E02F 3/60 37/397
5,433,547 A * 7/1995 Hart ..... F16B 39/32 403/154
7,393,033 B1 * 7/2008 Bisso, IV ..... F16G 15/06 294/82.1
7,540,140 B1 * 6/2009 Diaz ..... F16G 15/06 403/154

(Continued)

*Primary Examiner* — Robert Sandy
*Assistant Examiner* — Rowland Do
(74) *Attorney, Agent, or Firm* — Raymond Y. Chan; David and Raymond Patent Firm

(57) ABSTRACT

A lockable anti-fall catch connector includes a catch member, a locking shaft, and a locker unit. The catch member includes a retention arm and two sleeve members provided at two ends of the retention arm, wherein a first locking portion is provided at one of the sleeve members. The locking shaft is slidably extended between the sleeve members, wherein the locking shaft has a second locking portion detachably coupled with the first locking portion to lock up the locking shaft at the retention arm. The locker unit includes a locking element slidably coupled at one of the sleeve members to engage with the locking shaft, wherein after said locking element is disengaged with the locking shaft, the locking shaft is actuated to disengage the second locking portion with the first locking portion in order to slide the locking shaft with respect to the catch member.

8 Claims, 5 Drawing Sheets

(56) References Cited

U.S. PATENT DOCUMENTS

| | | | | |
|---|---|---|---|---|
| 8,938,864 | B2 * | 1/2015 | Casebolt | A62B 35/0037 24/573.11 |
| 9,163,378 | B2 * | 10/2015 | Doan | E02F 3/58 |
| 9,435,484 | B1 * | 9/2016 | Yang | F16B 45/04 |
| 9,903,440 | B2 * | 2/2018 | Ohman, III | F16G 11/00 |
| 2009/0196683 | A1 * | 8/2009 | Lunn | F16G 15/06 403/154 |
| 2012/0073088 | A1 * | 3/2012 | Boeckman | F16G 15/06 24/132 WL |
| 2013/0074469 | A1 * | 3/2013 | Robins | F16G 15/06 59/86 |

* cited by examiner

LOCKABLE ANTI-FALL CATCH CONNECTOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a catch connector, and more particularly to a lockable anti-fall catch connector, which can prevent the guiding gap from being accidentally opened.

Description of Related Arts

In the circumstances that operation constructions at height to mitigate the effects of gravity and falling, such as rock climbing, mountaineering, construction, etc., there must be a catch connector connecting to a safety belt and one or more anti-fall devices for safety purpose. Thus, the applicant of the present invention disclosed an anti-fall connecting device, Taiwanese Patent No. TW104205356, which is remarkable and is successful commercially.

In addition, the applicant found that the previous patent still has rooms for improvement. For example, the structures of the controlling hole, the controlling lever, the blocking hole, the second blocking element and the second spring of the second controlling assembly are complex, so that the manufacturing cost of the product is relatively high.

Moreover, the latching shaft has a hollow structure to bear an instant dropping stress. Once the controlling hole is deformed and the controlling lever is stuck, the hanger gap cannot be open at all.

The applicant works hard to research the technology thereof, and provides the present invention to improve the disadvantages of the conventional connector.

SUMMARY OF THE PRESENT INVENTION

The invention is advantageous in that it provides a lockable anti-fall catch connector, comprising:

a catch member which comprises a retention arm having two ends and a hanging space and defining a guiding gap between the two ends, a first sleeve member and a second sleeve member integrally formed at the two ends of the retention arm respectively, wherein the first sleeve member has a first sliding slot and the second sleeve member has a second sliding slot, wherein the first sliding slot and the second sliding slot are coaxially aligned and communicated with the guiding gap, wherein the catch member further has a guiding slot radially extended from and communicated with the first sliding slot and a first locking portion provided in at least one of the first sliding slot and the second sliding slot;

a locking shaft having a first end portion slidably inserted through the second sliding slot from the first sliding slot, and an opposed second end portion extended through the first sliding slot to close the guiding gap, wherein the locking shaft further has a main catching groove aligned with the guiding slot and a second locking portion detachably engaged with the first locking portion to provide a first safety structure to lock up the locking shaft at the guiding gap; and a locker unit which comprises a locking element slidably coupled at the guiding slot and a resilient element applying an urging force against the locking element to engage the locking element with the main catching groove so as to provide a second safety structure to lock up the locking shaft at the guiding gap.

The structural configuration of the present invention is simplified through the first locking portion and the second locking portion comparing to the prior art, i.e. Taiwanese Patent No. TW104205356, to minimize complicated structure thereof and to provide essential properties thereof. Since the locking shaft must be rotated to disengage the second locking portion from the first locking portion before the locking shaft is axially slid out from the second sleeve member, the two different operations of the locking shaft must be individually actuated in order to open up the guiding gap. In other words, the rotational operation and the axially pulling operation of the locking shaft are actuated separately and intentionally to prevent the guiding gap from being opened accidentally, so as to enhance the safety of the present invention.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
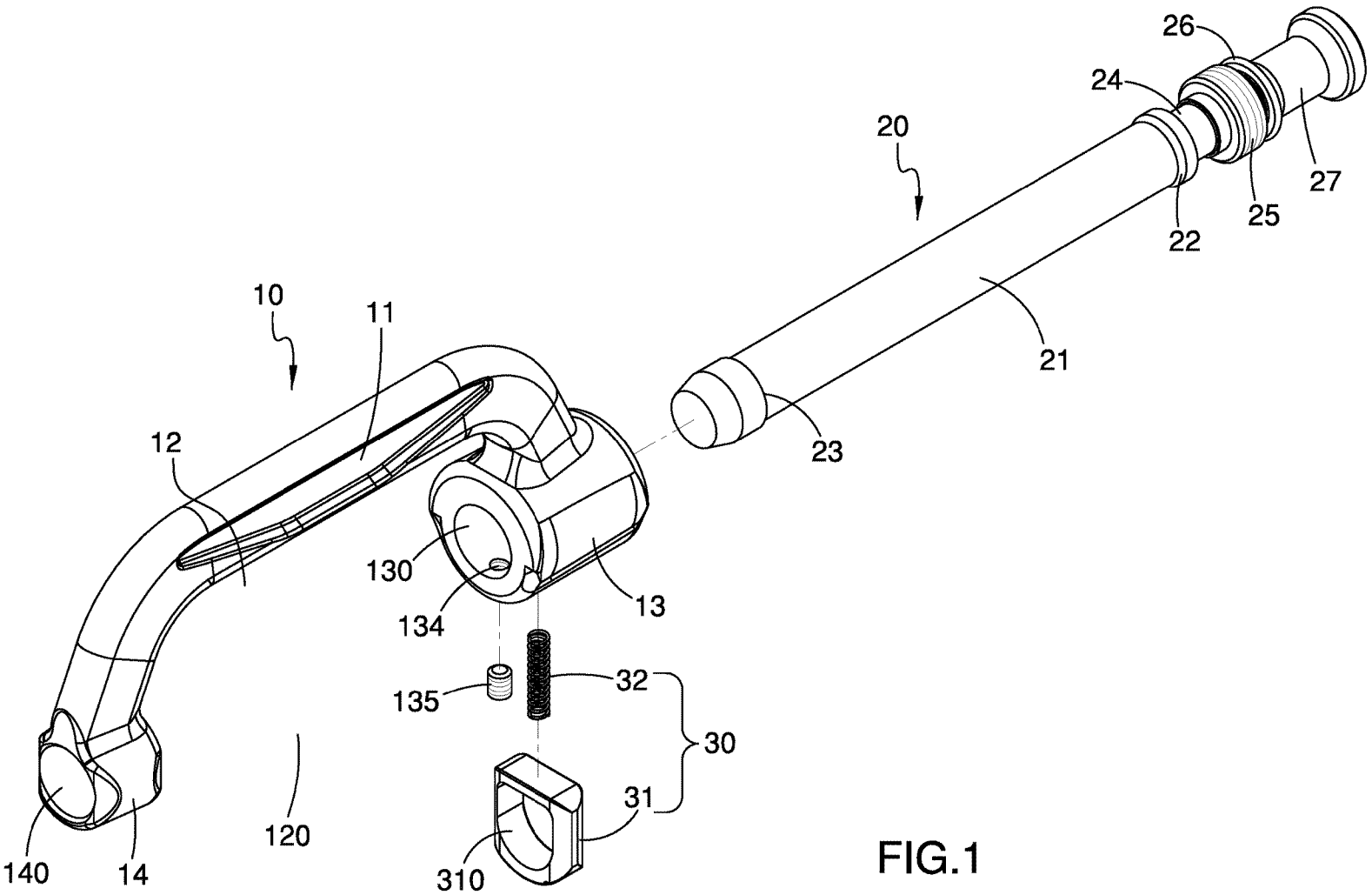
FIG. 1 is an exploded perspective view of a lockable anti-fall catch connector according to a preferred embodiment of the present invention.
Figure 2:
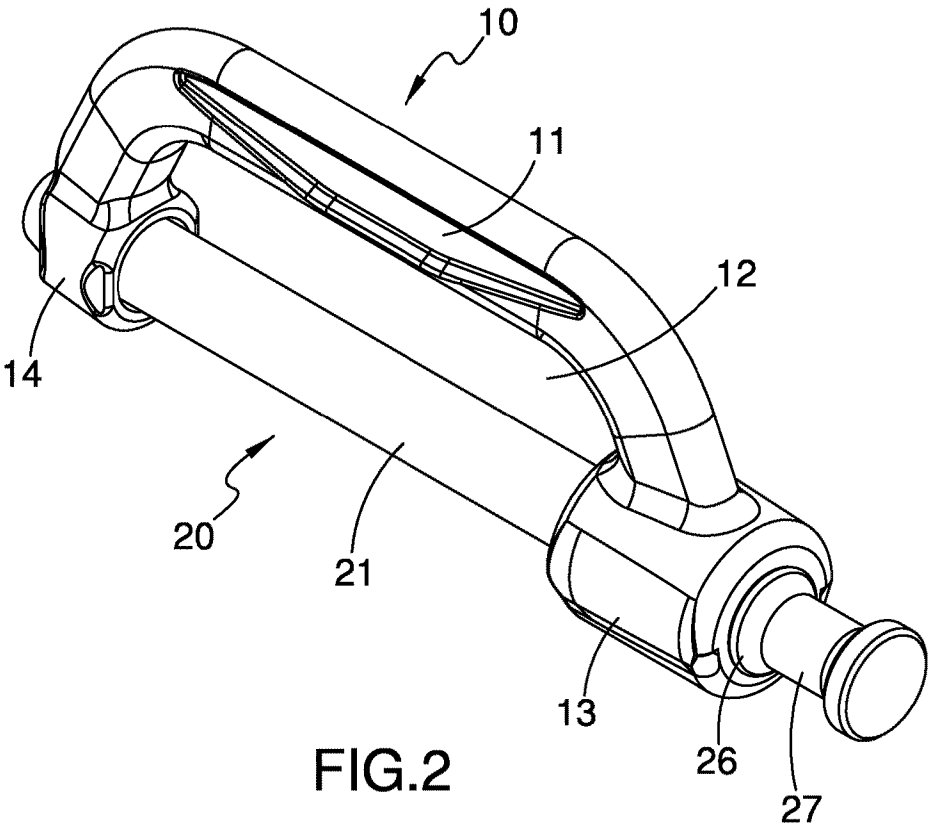
FIG. 2 is a perspective view of the lockable anti-fall catch connector according to the above preferred embodiment of the present invention, wherein the guiding gap being closed.
Figure 3:
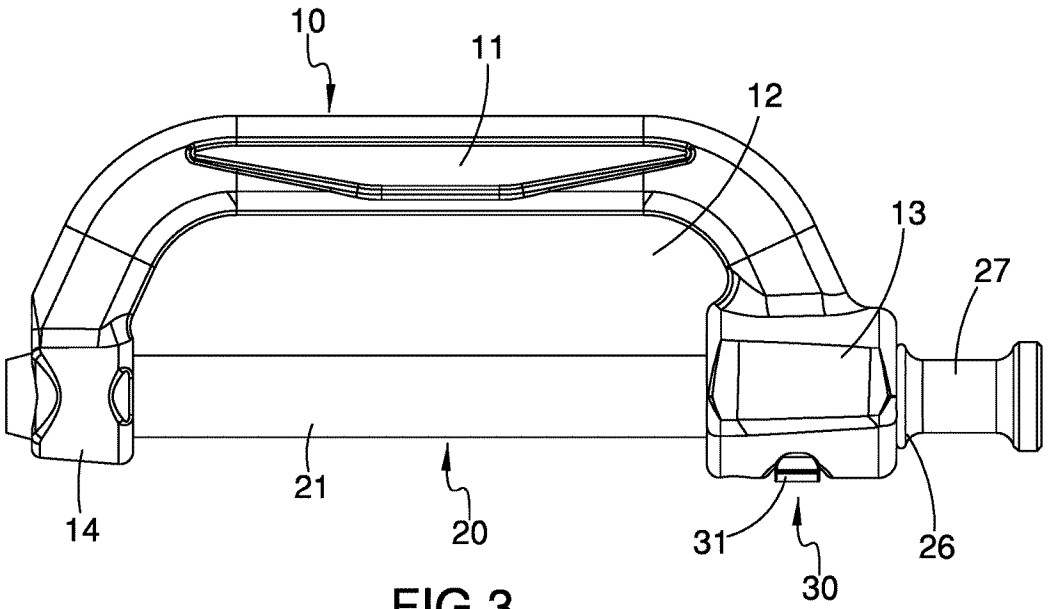
FIG. 3 is a front view of the lockable anti-fall catch connector according to the above preferred embodiment of the present invention.
Figure 4:
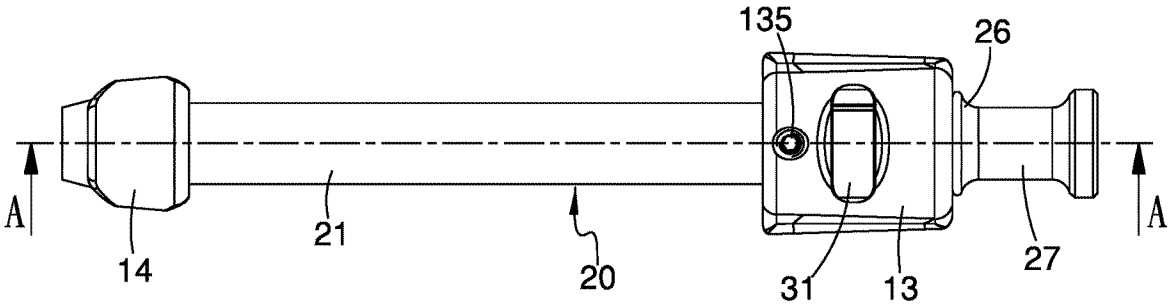
FIG. 4 is a bottom view of the lockable anti-fall catch connector according to the above preferred embodiment of the present invention.
Figure 5:
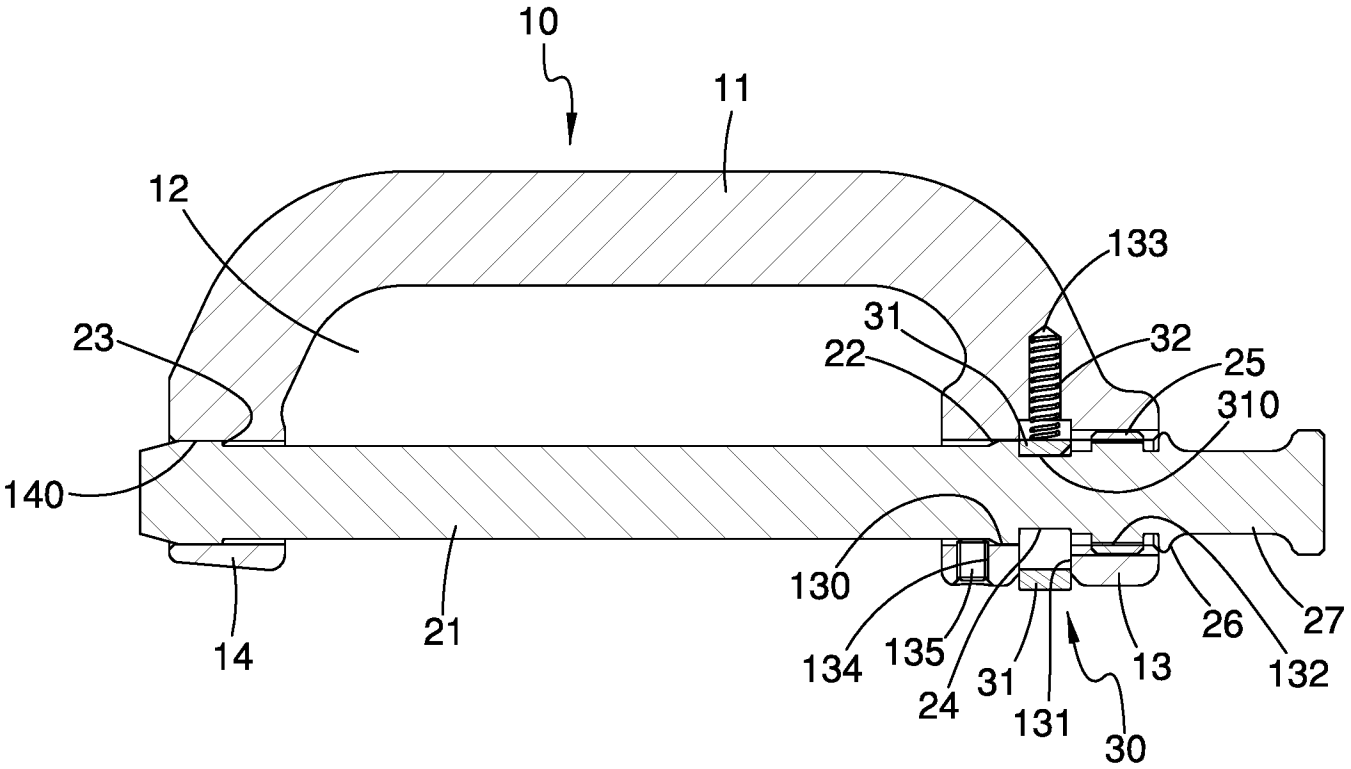
FIG. 5 is a sectional view of the lockable anti-fall catch connector according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 7 of the drawings, a lockable anti-fall catch connector according to a preferred embodiment of the present invention is illustrated, wherein the lockable anti-fall catch connector comprises a catch member 10, an elongated locking shaft 20, and a locker unit 30.

The catch member 10 comprises an elongated retention arm 11, which is formed in a generally U-shaped configuration, has two ends and a hanging space 12, and defines a guiding gap 120 between the two ends, a first sleeve member 13, i.e. a right sleeve member, integrally formed at one end of the retention arm 11, and a second sleeve member 14, i.e. a left sleeve member, integrally formed at another end of the retention arm 11, wherein the guiding gap 120 is formed between the first sleeve member 13 and the second sleeve member 14. In other words, the hanging space 12 is defined within the retention arm 11 and the guiding gap 120. The first sleeve member 13 has a first sliding slot 130 coaxially aligned and communicated with the guiding gap 120, a guiding slot 131 radially extended from and communicated with the first sliding slot 130, and a first locking portion 132 having an inner threaded structure formed at an inner wall of the first sliding slot 130. The guiding slot 131 is upwardly extended from a bottom side of the first sleeve member 13 to the first sliding slot 130, wherein the guiding slot 131 has an concaved indentation opening formed at the bottom side of the first sleeve member 13. In particular, the guiding slot 131 is extended through the first sliding slot 130 and is positioned adjacent to the first locking portion 132. The guiding slot 131 is located close to an inner opening of the first sliding slot 130 while the first locking portion 132 is located close to an outer opening of the first sliding slot 130, i.e. the guiding slot 131 is located at a left side of the first locking portion 132. In addition, the guiding slot 131 is extended across the first sliding slot 130, such that a bottom portion of the guiding slot 131 is formed at a bottom portion of the first sleeve member 13 and an upper portion of the guiding slot 131 is formed at an upper portion of the first sleeve member 13. The upper and bottom portions of the guiding slot 131 are upwardly and coaxially aligned with each other. The first sleeve member 13 further has a spring slot 133 coaxially extended from the upper portion of the guiding slot 131, wherein a diameter size of the spring slot 133 is smaller than a diameter side of the guiding slot 131. The first sleeve member 13 further has a screw hole 134 which is upwardly extended from the bottom side of the first sleeve member 13 and is radially extended from and communicated with the first sliding slot 130, wherein the screw hole 134 is located adjacent to the guiding slot 131, i.e. to the left side of the guiding slot 131. The first sleeve member 13 further comprises a stopper bolt 135 rotatably coupled at the screw hole 134, wherein a top end of the stopper bolt 135 is slightly protruded from the screw hole 134 within the first sliding slot 131 when the stopper bolt 135 is actuated and rotated in the screw hole 134. Accordingly, the second sleeve member 14 has a second sliding slot 140 coaxially aligned with the first sliding slot 130 of the first sleeve member 13.

Figure 6:
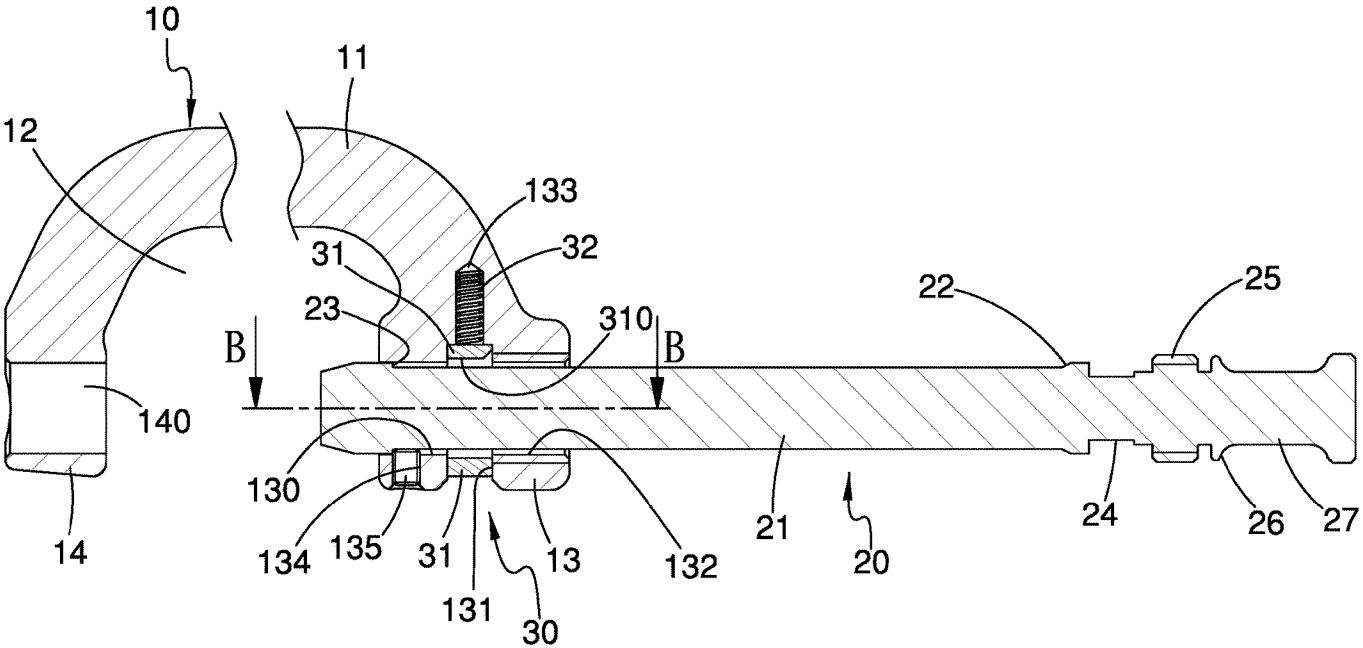
FIG. 6 is a sectional view of the lockable anti-fall catch connector according to the above preferred embodiment of the present invention, illustrating the guiding gap being opened.
Figure 7:
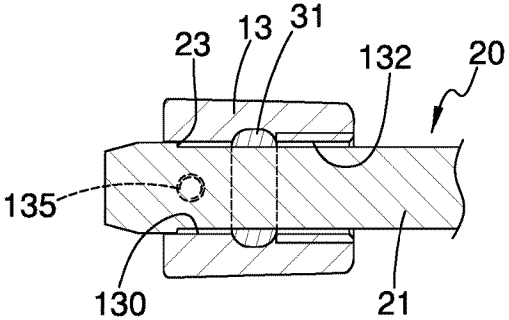
FIG. 7 is a partially sectional view of the lockable anti-fall catch connector according to the above preferred embodiment of the present invention, illustrating the structural relationship between the first sleeve member and the locking shaft.

The locking shaft 20 has a first end portion, i.e. the left end portion, slidably passed through the first sliding slot 130 of the first sleeve member 13 to insert through the second sliding slot 140 of the second sleeve member 14, and an opposed second end portion, i.e. the right end portion, is extended through the first sliding slot 130 of the first sleeve member 13. Therefore, the locking shaft 20 is slidably coupled at the two ends of the retention arm 11 through the guiding gap 120 to close the hanging space 12. The locking shaft 20 has a narrow neck portion 21, having a smaller diameter, aligned with the guiding gap 120, such that the narrow neck portion 21 of the locking shaft 20 is formed between two ends of the retention arm 11. The locking shaft 20 further has a first annular shoulder 22, i.e. a right annular shoulder, formed at one end (right end) of the narrow neck portion 21 to bias against the stopper bolt 135, and a second annular shoulder 23, i.e. a left annular shoulder, formed at another end (left end) of the narrow neck portion 21 of the locking shaft 20 to bias against the stopper bolt 135. Accordingly, the stopper bolt 135 is biased between the first annular shoulder 22 and the second annular shoulder 23, such that the locking shaft 20 is locked at the catch member 10 to block the sliding movement of the locking shaft 20 so as to prevent the locking shaft 20 from being detached from the locking shaft 20. In other words, the sliding movement of the locking shaft 20 is limited between the first annular shoulder 22 and the second annular shoulder 23. In particular, after the locking shaft 20 is slid to engage with the catch member 10, the top end of the stopper bolt 135 is located at the narrow neck portion 21 between the first annular shoulder 22 and the second annular shoulder 23 to lock up the locking shaft 20, as shown in FIGS. 6 and 7, for preventing the locking shaft 20 from being slidably detached from the catch member 10. The locking shaft 20 further has a main catching groove 24 indentedly provided at the second end portion at a position adjacent to the first annular shoulder 22 to align with the guiding slot 131, wherein the main catching groove 24 is indentedly formed at the circumferential surface of the locking shaft 20. The locking shaft 20 further comprises a second locking portion 25 aligned with the first locking portion 132 for providing a first safety structure to ensure the locking shaft 20 being extended through the guiding gap 120 to close the hanging space 12. Accordingly, the second locking portion 25 has an outer threaded structure rotatably and detachably engaged with the first locking portion 132. The main catching groove 24 is located between the first annular shoulder 22 and the second locking portion 25. The locking shaft 20 further has a blocking rim 26 radially protruded from the locking shaft 20 to align with and bias against the right end of the first sleeve member 13 when the second locking portion 25 is rotatably engaged with the first locking portion 132. In other words, the second locking portion 25 is located between the main catching groove 24 and the blocking rim 26. The locking shaft 20 further has a handle portion 27 extended from the blocking rim 26, wherein the user is able to hold and grip the handle portion 27 to couple the locking shaft 20 with the catch member 10.

The locker unit 30 comprises a locking element 31 slidably coupled at the guiding slot 131, wherein the locking element 31 has a locking through hole 310 for the locking shaft 20 passing therethrough. In other words, when the locking through hole 310 is coaxially aligned with the first sliding slot 130, the locking shaft 20 is adapted to slide within the first sliding slot 130, and when the locking through hole 310 is misaligned with the first sliding slot 130, the locking element 31 is engaged with the main catching groove 24 to lock up with the locking shaft 20. The locker unit 30 further comprises a resilient element 32, such as a compression spring, disposed in the spring slot 133 for applying an urging force to bias against the locking element 31. In other words, one end of the resilient element 32 is biased against a ceiling of the spring slot 133 and another end of the resilient element 32 is biased against a top side of the locking element 31. Therefore, the resilient element 32 will push a bottom side of the locking element 31 out of the guiding slot 131. In other words, the bottom side of the locking element 31 is protruded from the bottom side of the first sleeve member 13, wherein the top side of the locking element 31 is engaged with the main catching groove 24 of the locking shaft 20 for providing a second safety structure.

According to the preferred embodiment, the lockable anti-fall catch connector provides the first safety structure that the second locking portion 25 is rotatably engaged with the first locking portion 132 for ensuring the locking shaft 20 being extended through the guiding gap 120 to close the hanging space 12. In addition, the lockable anti-fall catch connector provides the second safety structure that the locking shaft 20 is locked by the locker unit 30 for further ensuring the locking shaft 20 being extended through the guiding gap 120 to close the hanging space 12. Therefore, the present invention provides a double-safety configuration to prevent the locking shaft 20 being accidentally detached from the catch member 10.

In order to open up the guiding gap 120, the user can firstly press on the locking element 31 by one hand to push the locking element 31 against the resilient element 32 until the top side of the locking element 31 is disengaged with the main catching groove 24. Then, the user is able to rotate the locking shaft 20 at the handle portion 27 by another hand, such that the second locking portion 25 of the locking shaft 20 is rotatably disengaged with the first locking portion 132. Therefore, the locking shaft 20 can be axially pulled out to remove the first end portion of the locking shaft 20 from the first sleeve member 13 to open up the guiding gap 120. It is worth mentioning that the locking shaft 20 is slid until the second annular shoulder 23 is biased against the stopper bolt 135 to fully open up the guiding gap 120 for mounting or dismounting an anti-fall device and/or a safety belt.

It is appreciated that the first locking portion 132 can be provided at the first sliding slot 130 as shown in FIG. 1. Alternatively, the first locking portion 132 can be provided at the second sliding slot 140. Correspondingly, the second locking portion 25 can be provided at the first end portion of the locking shaft 20 when the first locking portion 132 is provided at the second sliding slot 140. In addition, two first locking portions 132 can be provided at first sliding slot 130 and the second sliding slot 140 respectively, wherein two corresponding second locking portions 25 can be provided at the first end portion and the second end portion of the locking shaft 20 respectively.

Accordingly, the present invention provides the following advantages.

1. The structural configuration of the present invention is simplified through the first locking portion 132 and the second locking portion 25 comparing to the prior art, i.e. Taiwanese Patent No. TW104205356, to minimize complicated structure of the controlling hole, the controlling lever, the blocking hole, the second blocking element and the second spring. The cost of the present invention can be reduced. In addition, the locking shaft 20 is rigid enough for preventing any deformation.

2. Since the locking shaft 20 must be rotated to disengage the second locking portion 25 from the first locking portion 132 before the locking shaft 20 is axially slid out from the second sleeve member 14, the two different operations of the locking shaft 20 must be individually actuated in order to open up the guiding gap 120. In other words, the rotational operation and the axially pulling operation of the locking shaft 20 are actuated separately and intentionally to prevent the guiding gap 120 from being opened accidentally, so as to enhance the safety of the present invention.

The structure has not been provided by the prior art. The design is excellent, and has not been found in published creation in the field of the invention. It conforms to the requirements of patent application, so that the present application is applied.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lockable anti-fall catch connector, comprising: a catch member which comprises a retention arm having two ends and a hanging space and defining a guiding gap between said two ends, a first sleeve member and a second sleeve member integrally formed at said two ends of said retention arm respectively, wherein said first sleeve member has a first sliding slot and said second sleeve member has a second sliding slot, wherein said first sliding slot and said second sliding slot are coaxially aligned and communicated with said guiding gap, wherein said catch member further has a guiding slot radially extended from and communicated with said first sliding slot, and a first locking portion provided in at least one of said first sliding slot and said second sliding slot; a locking shaft having a first end portion slidably inserted through said second sliding slot from said first sliding slot, and an opposed second end portion extended through said first sliding slot to close said guiding gap, wherein said locking shaft further has a main catching groove aligned with said guiding slot and a second locking portion detachably engaged with said first locking portion to provide a first safety structure to lock up said locking shaft at said guiding gap; and a locker unit which comprises a locking element slidably coupled at said guiding slot and a resilient element applying an urging force against said locking element to engage the locking element with said main catching groove so as to provide a second safety structure to lock up said locking shaft at said guiding gap, wherein said first locking portion has an inner threaded structure and said second locking portion has a corresponding outer thread structure to detachably engage with said first locking portion.

2. The lockable anti-fall catch connector, as recited in claim 1, wherein said first locking portion is formed at said first sleeve member and said guiding slot is formed through said first sleeve member at a position adjacent to said first locking portion.

3. The lockable anti-fall catch connector, as recited in claim 1, wherein said locking shaft further has a blocking rim radially protruded from said locking shaft to align with and bias against one end of said first sleeve member when said second locking portion is rotatably engaged with said first locking portion, and a handle portion extended from said blocking edge.

4. The lockable anti-fall catch connector, as recited in claim 1, wherein said first sleeve member further has a screw hole provided at said first sleeve member to communicate with said first sliding slot, wherein said screw hole is located adjacent to said guiding slot, wherein said first sleeve member further comprises a stopper bolt rotatably coupled at said screw hole, wherein a top end of said stopper bolt is slightly protruded from said screw hole within said first sliding slot when said stopper bolt actuated and rotated in said screw hole, wherein said locking latch has narrow neck portion which has a smaller diameter, a first annular shoulder, and a second annular shoulder, wherein said narrow neck portion is located between said first annular should and said second annular, wherein said top end of said stopper bolt is extended between said first annular shoulder and said second annular shoulder to lock up said locking shaft for preventing said locking shaft from being slidably detached from said catch member.

5. The lockable anti-fall catch connector, as recited in claim 1, wherein said guiding slot is extended across said first sliding slot, such that a bottom portion of said guiding slot is formed at a bottom portion of said first sleeve member and an upper portion of said guiding slot is formed at an upper portion of said first sleeve member, wherein said first sleeve member further has a spring slot coaxially extended from said upper portion of said guiding slot, wherein said locking element has a locking through hole for said locking shaft passing therethrough, wherein said resilient element is disposed in said spring slot to push one side of said locking element out of said guiding slot while another side of said locking element is engaged with said main catching groove.

6. A lockable anti-fall catch connector, comprising: a catch member which comprises a retention arm having two ends and a hanging space and defining a guiding gap between said two ends, a first sleeve member and a second sleeve member integrally formed at said two ends of said retention arm respectively, wherein said first sleeve member has a first sliding slot and said second sleeve member has a second sliding slot, wherein said first sliding slot and said second sliding slot are coaxially aligned and communicated with said guiding gap, wherein said catch member further has a guiding slot radially extended from and communicated with said first sliding slot, and a first locking portion provided in at least one of said first sliding slot and said second sliding slot; a locking shaft having a first end portion slidably inserted through said second sliding slot from said first sliding slot, and an opposed second end portion extended through said first sliding slot to close said guiding gap, wherein said locking shaft further has a main catching groove aligned with said guiding slot and a second locking portion detachably engaged with said first locking portion to provide a first safety structure to lock up said locking shaft at said guiding gap; and a locker unit which comprises a locking element slidably coupled at said guiding slot and a resilient element applying an urging force against said locking element to engage the locking element with said main catching groove so as to provide a second safety structure to lock up said locking shaft at said guiding gap, wherein said guiding slot is extended across said first sliding slot, such that a bottom portion of said guiding slot is formed at a bottom portion of said first sleeve member and an upper portion of said guiding slot is formed at an upper portion of said first sleeve member, wherein said first sleeve member further has a spring slot coaxially extended from said upper portion of said guiding slot, wherein said locking element has a locking through hole for said locking shaft passing therethrough, wherein said resilient element is disposed in said spring slot to push one side of said locking element out of said guiding slot while another side of said locking element is engaged with said main catching groove.

7. A lockable anti-fall catch connector, comprising: a catch member which comprises a retention arm having two ends and a hanging space and defining a guiding gap between said two ends, a first sleeve member and a second sleeve member integrally formed at said two ends of said retention arm respectively, wherein said first sleeve member has a first sliding slot and said second sleeve member has a second sliding slot, wherein said first sliding slot and said second sliding slot are coaxially aligned and communicated with said guiding gap, wherein said catch member further has a first locking portion having an inner threaded structure provided in at least one of said first sliding slot and said second sliding slot, wherein said catch member further has a guiding slot radially extended from and communicated with said first sliding slot; a locking shaft, which is slidably extended through said first sliding slot and said second sliding slot to selectively close said guiding gap, wherein said locking shaft further has a main catching groove and a second locking portion detachably engaged with said first locking portion to align said main catching groove with said guiding slot; and a locker unit which comprises a locking element slidably coupled at said guiding slot to engage with said main catching groove, wherein after said locking element is moved to disengage with said main catching groove, said locking shaft is actuated to disengage said second locking portion with said first locking portion in order to slide said locking shaft with respect to said catch member for opening up said guiding gap, wherein said locking element has a locking through hole for said locking shaft passing therethrough, wherein when said locking through hole is coaxially aligned with said first sliding slot, said locking shaft is adapted to slide within said first sliding slot, and when said locking through hole is misaligned with said first sliding slot, said locking element is engaged with said main catching groove to lock up with said locking shaft.

8. The lockable anti-fall catch connector, as recited in claim 7, wherein said guiding slot is extended across said first sliding slot, such that a bottom portion of said guiding slot is formed at a bottom portion of said first sleeve member and an upper portion of said guiding slot is formed at an upper portion of said first sleeve member, wherein said first sleeve member further has a spring slot coaxially extended from said upper portion of said guiding slot, wherein said locker unit further comprises a resilient element disposed in said spring slot to push one side of said locking element out of said guiding slot while another side of said locking element is engaged with said main catching groove.

* * * * *